US008800314B2

(12) United States Patent
Mitchell

(10) Patent No.: US 8,800,314 B2
(45) Date of Patent: Aug. 12, 2014

(54) MISTING ICE MAKER FOR CUP-SHAPED ICE CUBES AND RELATED REFRIGERATION APPLIANCE

(75) Inventor: Alan Joseph Mitchell, Louisville, KY (US)

(73) Assignee: General Electric Company, Schenectady, NY (US)

( * ) Notice: Subject to any disclaimer, the term of this patent is extended or adjusted under 35 U.S.C. 154(b) by 964 days.

(21) Appl. No.: 12/910,109

(22) Filed: Oct. 22, 2010

(65) Prior Publication Data

US 2012/0096890 A1 Apr. 26, 2012

(51) Int. Cl.

| | |
|---|---|
| ***F25C 1/00*** | (2006.01) |
| ***F25C 5/00*** | (2006.01) |
| ***F25C 1/12*** | (2006.01) |
| ***F25C 1/22*** | (2006.01) |

(52) U.S. Cl.

CPC . *F25C 1/12* (2013.01); *F25C 5/005* (2013.01); *F25C 2700/04* (2013.01); *F25C 1/22* (2013.01)

USPC ..... 62/347; 62/351

(58) Field of Classification Search

CPC ..... F25C 1/12; F25C 1/22; F25C 2700/04; F25C 5/005

USPC ..... 62/344, 347, 351

See application file for complete search history.

(56) References Cited

U.S. PATENT DOCUMENTS

| | | | | | |
|---|---|---|---|---|---|
| 2,004,014 | A * | 6/1935 | Sanford | 62/350 |
| 2,252,913 | A * | 8/1941 | Baer | 62/71 |
| 2,770,102 | A * | 11/1956 | Roedter | 62/137 |
| 3,046,753 | A * | 7/1962 | Carapico, Jr. | 62/132 |
| 3,403,532 | A * | 10/1968 | Knowles | 62/347 |
| 3,418,823 | A * | 12/1968 | Salimbeni Vivai | 62/138 |
| 3,580,007 | A * | 5/1971 | Bauerlein | 62/345 |
| 3,659,827 | A * | 5/1972 | Fogt | 366/315 |
| 4,942,742 | A * | 7/1990 | Burruel | 62/347 |
| 4,970,877 | A | 11/1990 | Dimijian | |
| 5,265,439 | A * | 11/1993 | Hobelsberger | 62/356 |
| 5,970,735 | A * | 10/1999 | Hobelsberger | 62/356 |
| 6,101,833 | A * | 8/2000 | Suzuki | 62/340 |
| 6,557,351 | B1 * | 5/2003 | Ghedini et al. | 62/1 |
| 7,077,156 | B1 * | 7/2006 | Humber et al. | 137/360 |
| 7,540,161 | B2 | 6/2009 | Broadbent et al. | |
| 8,677,774 | B2 * | 3/2014 | Yamaguchi et al. | 62/340 |
| 2002/0002836 | A1 * | 1/2002 | Kawasumi et al. | 62/347 |
| 2008/0127656 | A1 * | 6/2008 | Bucceri | 62/68 |
| 2008/0196429 | A1 * | 8/2008 | Petrenko et al. | 62/207 |
| 2009/0320501 | A1 * | 12/2009 | Morimoto et al. | 62/66 |

* cited by examiner

*Primary Examiner* — Mohammad M Ali

(74) *Attorney, Agent, or Firm* — Dority & Manning, P.A.

(57) ABSTRACT

An ice cube maker includes an ice-making compartment having side walls, at least one rod-shaped conductor extending distally into the compartment through one of the side walls, and a cooling device for cooling the conductor to a temperature sufficient to form ice on the conductor. A misting system includes a reservoir for water and a nebulizer for creating a liquid mist from water in the reservoir and introducing the liquid mist into the ice-making compartment so that a portion of the liquid mist freezes on the conductor to form a cup-shaped ice cube thereon. A return conduit connects a drain of the ice-making compartment and the reservoir for transferring liquid mist not freezing on the conductor to the reservoir.

20 Claims, 3 Drawing Sheets

MISTING ICE MAKER FOR CUP-SHAPED ICE CUBES AND RELATED REFRIGERATION APPLIANCE

FIELD OF THE INVENTION

The subject matter disclosed herein relates generally to misting ice makers that form cup-shaped ice cubes and to refrigeration appliances with such ice makers.

BACKGROUND OF THE INVENTION

Various ice maker designs have been proposed for refrigeration appliances such as commercial or home refrigerators and/or freezers. In certain ice makers known as misting ice makers a liquid mist is sprayed into a compartment. Within the compartment are a number of cooled elements cooled sufficiently that the liquid mist can freeze thereon. U.S. Pat. Nos. 4,970,877 and 7,540,161 disclose such ice makers wherein a liquid mist is used to form ice.

In such ice forming devices, unusually-shaped elements are employed as the cooled surfaces. Use of such surfaces provides a certain volume of ice production, but may do so while also producing ice having contours that may not be desirable to some consumers. In U.S. Pat. No. 7,540,161, plates, corrugated sheets, and waffle style pans are employed to form ice thereon. Different thermal properties are possible on the plates. In U.S. Pat. No. 4,970,877, a series of cone shaped elements with thermally insulated portions forms ice balls with cone-shaped holes in them. These shapes may not be preferred by certain consumers for certain applications, and the ice making elements include complexity in their respective designs.

Accordingly, it would be desirable to provide a misting ice maker that provides ice cubes in a more conventional shape, while employing system less complicated than those above.

BRIEF DESCRIPTION OF THE INVENTION

Aspects and advantages of the invention will be set forth in part in the following description, or may be obvious from the description, or may be learned through practice of the invention.

According to certain aspects of the disclosure, an ice cube maker includes an ice-making compartment having side walls, at least one rod-shaped conductor extending distally into the compartment through one of the side walls, and a cooling device for cooling the conductor to a temperature sufficient to form ice on the conductor. A misting system includes a reservoir for water and a pumping device for creating a liquid mist from water in the reservoir and introducing the liquid mist into the ice-making compartment so that a portion of the liquid mist freezes on the conductor to form a cup-shaped ice cube thereon. A return conduit connects a drain of the ice-making compartment and the reservoir for transferring liquid mist not freezing on the conductor to the reservoir. Various options and modifications are possible.

According to certain other aspects of the disclosure, an ice cube maker includes an ice-making compartment having side walls, at least one rod-shaped conductor extending distally into the compartment through one of the side walls, and a cooling device for cooling the conductor to a temperature sufficient to form ice on the conductor. A misting system includes a reservoir for water and a pumping device for creating a liquid mist from water in the reservoir and introducing the liquid mist into the ice-making compartment so that a portion of the liquid mist freezes on the conductor to form a cup-shaped ice cube thereon. A return conduit connects a drain of the ice-making compartment and the reservoir for transferring liquid mist not freezing on the conductor to the reservoir. The misting system includes a water source for filling the reservoir in case a low water sensor signals a low water condition in the reservoir. The water source fills the reservoir until a high water condition is reached. The amount of water needed to create a desired amount of ice in an ice cube harvest is substantially equal to the difference between the high water condition and low water condition. As above, various options and modifications are possible.

According to certain other aspects of the disclosure, a refrigeration appliance includes a refrigerated compartment and an ice-making compartment within the refrigerated compartment and having side walls. At least one rod-shaped conductor extends distally into the compartment through one of the side walls. A cooling device cools the conductor to a temperature sufficient to form ice on the conductor. A misting system includes a reservoir for water, a pumping device for creating a liquid mist from water in the reservoir and introducing the liquid mist into the ice-making compartment so that a portion of the liquid mist freezes on the conductor to form a cup-shaped ice cube thereon. A return conduit connects a drain of the ice-making compartment and the reservoir for transferring liquid mist not freezing on the conductor to the reservoir. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
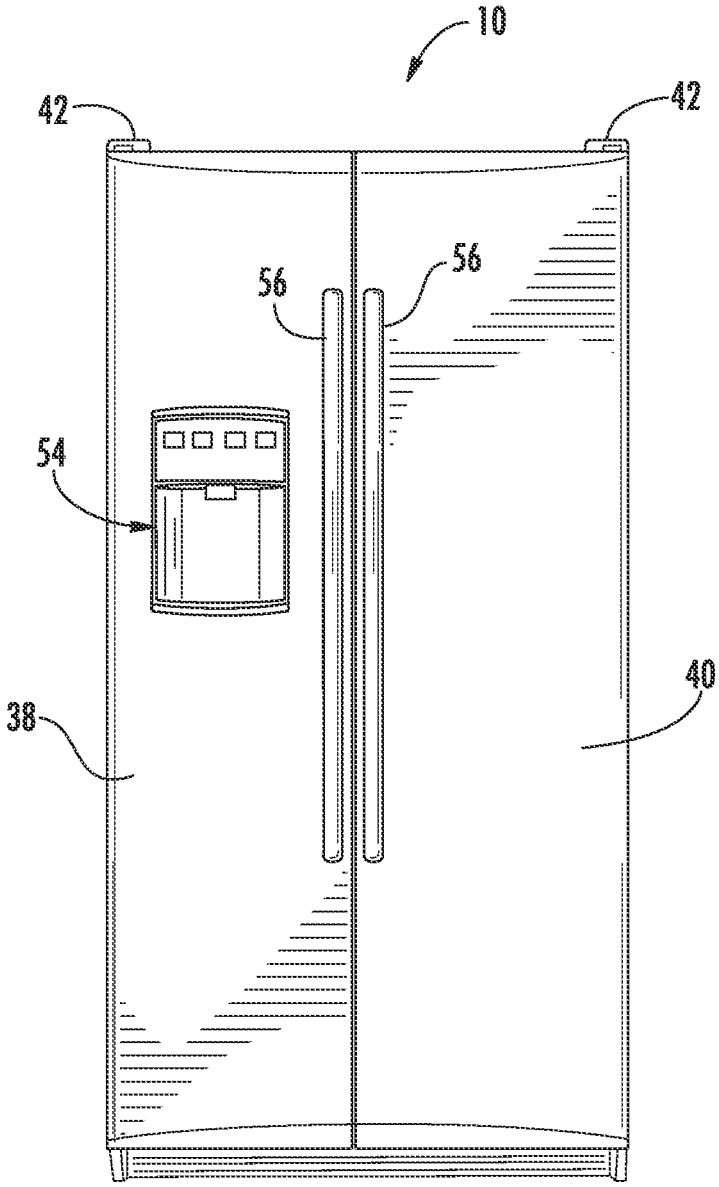
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a frontal view of an exemplary refrigeration appliance 10 depicted as a refrigerator in which dispenser target indicating assemblies in accordance with aspects of the present invention may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth. The present disclosure may be especially suitable for a compact refrigerator and/or freezer appliance where space is at a premium and an ice-making capability is desired. However, the disclosed ice-making assembly may be used with any such appliance.

Figure 2:
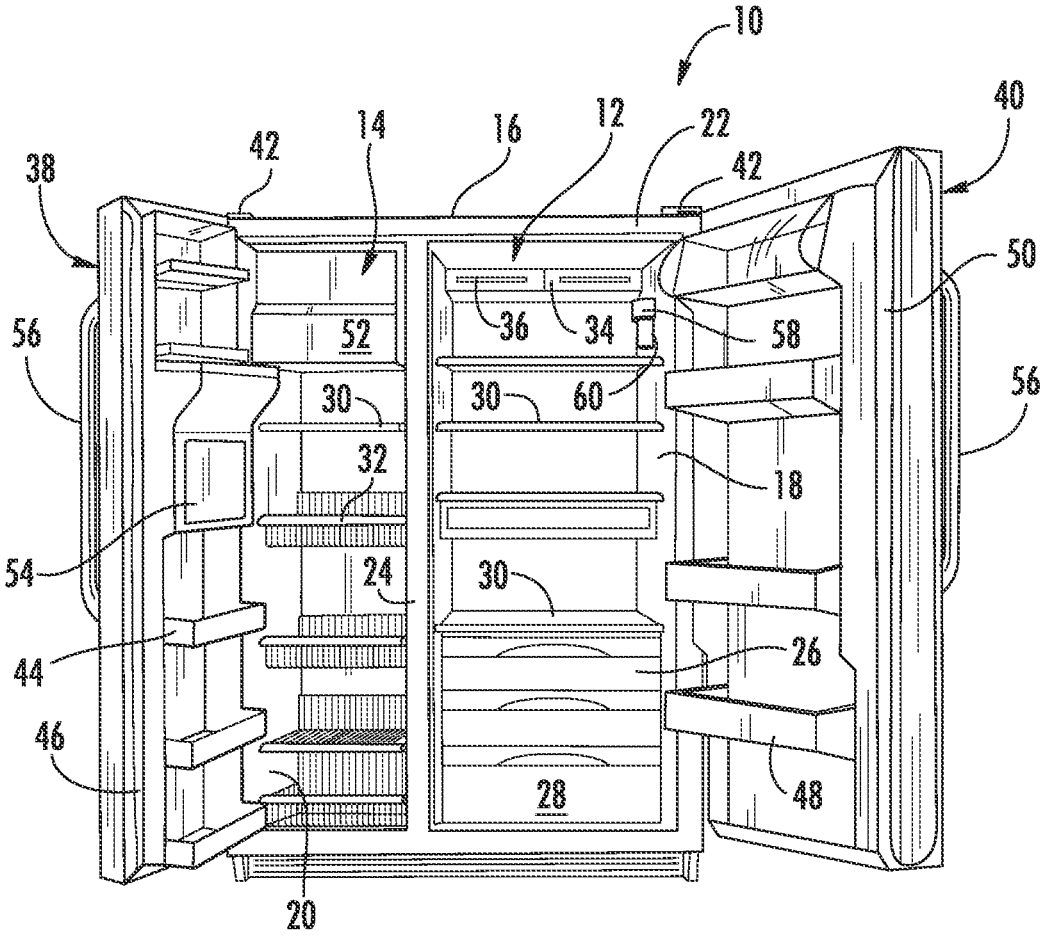
FIG. 2 provides a front view of the refrigeration appliance of FIG. 1 with its doors opened.

Referring to FIG. 2 the refrigerator 10 includes a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 is conventional. A housing 58 may hold a water filter 60 used to filter water for the ice maker 52 and/or dispenser 54.

As with known refrigerators, the refrigerator 10 also includes a machinery compartment (not shown) that at least partially contains components for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to directly cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

Figure 3:
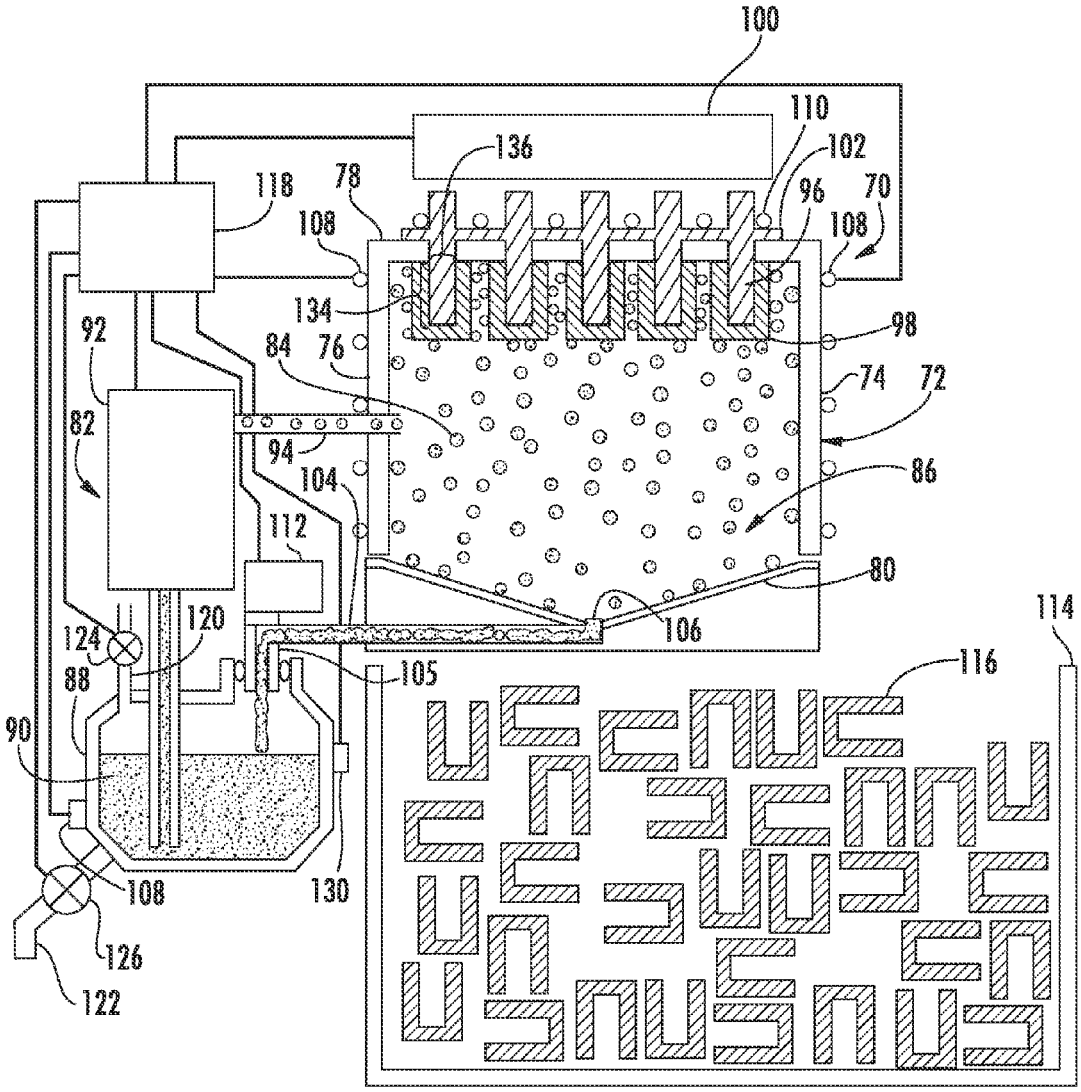
FIG. 3 provides a schematic view of an ice making assembly according to certain aspects of the present disclosure.

FIG. 3 shows one example of an ice making assembly 70 according to certain aspects of the disclosure. Ice making assembly 70 could comprise a device such as ice maker 52 within a refrigerated compartment as shown above or could comprise a device in another location such as a door, or another type of refrigeration appliance.

Ice making assembly 70 includes an ice-making compartment 72 having walls 74, 76, 78, 80. A misting system 82 provides a liquid mist 84 to an interior area 86 of the compartment 72. Misting system 82 includes a reservoir 88 for water 90, a pumping device 92 such as a nebulizer, sprayer, nozzle, piezoelectric device, etc. for creating liquid mist 84 from the water in the reservoir. Pumping device 92 introduces liquid mist 84 into ice-making compartment 72 via a compartment inlet 94. Reservoir 88 may be cooled to a temperature close to the freezing point so that mist 84 freezes more readily on conductors 96.

At least one cooled, rod-shaped conductor 96 extends distally into compartment 72 through one of the walls 74, 76, 78 so that a portion of liquid mist 84 freezes on the conductor to form a cup-shaped ice cube 98 on the conductor. As shown, a row of five such conductors 96 is present. If desired several rows of such conductors could be provided, for example in a grid orientation, sized to fit the desired location and/or ice-making capability. Reservoir 88 may be cooled to a temperature close to the freezing point so that mist 84 freezes more readily on conductors 96.

A cooling device 100 cools conductors 96 to a temperature sufficient to form ice on the conductors. Cooling device 100 could be a cooling plate (cooled by refrigerant) in contact with conductors directly or indirectly, a fan to blow cold air on the conductors, etc. Structure 102 could be provided to thermally link conductors 96 as well. Therefore, any suitable cooling device could be used.

A return conduit 104 connects a drain 106 of ice-making compartment 72 and reservoir 88 for transferring liquid mist 84 that does not freeze on conductor 96 and falls onto bottom wall 80 back to the reservoir. If desired, bottom wall 80 can be angled so that water drains more readily into drain 106.

If desired, a wall heater 108 can be provide for the ice-making compartment side walls 74, 76 to heat the side walls to a temperature sufficient to prevent liquid mist 84 from freezing on the side walls. A conductor heater 110 can also be provided for heating conductors 96 to a temperature sufficient to harvest ice cubes 98 from the conductors. Conductor heater 110 is turned on periodically to warm conductors 96 just enough that ice cubes 98 melt slightly where contacting the conductors and fall off the conductors for harvest. As shown, wall heater 108 and conductor heater 110 can both comprise one or more electrical resistance heaters or the like.

Bottom wall 80 may be movable between a first ice-forming position (shown in FIG. 3) and a second ice-dispensing position for harvest (see arrows in FIG. 3). Bottom wall 80 may thus be rotatable, hinged, slidable, etc., if desired. A motor 112 may be provided to move bottom wall 80 between positions by pivoting return conduit 104 and bottom wall 80 around vertical return conduit portion 105. An ice bucket 114 may be located for receiving finished ice cubes 116 from the ice making compartment when the bottom wall is in the ice dispensing position. Ice bucket 114 may be removable or fixed, and may itself have a dispensing mechanism (not shown). Thus, any sort of container could be provided for receiving finished ice cubes 116.

A dedicated controller 118 can be provided to control the various portions of ice making assembly 70. Alternately, main appliance controller 34 can be used for this purpose. As shown, a water source 120 provides water to reservoir 88 when needed. An optional water outlet 122 can dispense chilled water to a user. Valves 124, 126 can be controlled by controller 118 or 34 to fill and empty reservoir 88 as needed.

If desired, a low water sensor 128 can be located in reservoir 88 for sensing a water level that indicates reservoir 88 should have water added, for example if enough ice has been made to remove that amount from the system and/or if a user has taken chilled water out via outlet 122. Low water sensor 128 signals controller 118 that a low water condition has been reached, and the controller causes reservoir 88 to be refilled, for example by opening valve 124 on inlet 120. If desired, controller 118 may initiate ice cube harvest by stopping pumping device 92 from forming mist 84, moving bottom wall 80 to the dispensing position, and causing heater 110 to heat conductors 96 when low water sensor 128 senses the low water condition (possibly indicating a corresponding amount of water has turned into ice on conductors 96). Alternately, such steps could occur after a given amount of time or based on some other factor.

An optional high water sensor 130 could also be used in reservoir 88. High water sensor 130 signals controller 118 when a high water condition is reached, for example during refilling, causing the water source 120 to stop supplying water to reservoir 88 by the closing of valve 124. If both a high water sensor 130 and low water sensor a 128 re employed, they could be separated by a height whereby the volume of water in reservoir 88 corresponding to that height corresponds to a desired amount of water needed to create a complete set of ice cubes 98 on conductors 96. Thus, absent and withdrawal of water from reservoir 88 by a user through outlet 122, when enough of the water cycling through the system freezes on conductors 96 to drop the water level from high water sensor 130 to low water sensor 128, ice cube harvest can begin. Controller 118 can also factor in how much water has been removed by a user through outlet 122 and refill that amount through inlet 120, if desired. Alternatively, reservoir 88 can be smaller than is needed for a full ice harvest, and controller 118 can cause repeated refilling of the reservoir, the controller keeping track of water lost to ice making, water added to reservoir, and water dispensed through outlet until a net amount of water lost to ice making is reached, at which point harvest occurs. Ice making could be stopped if bottom wall 80 or any other item or sensor detects that ice bucket 114 is full. Therefore, numerous control scenarios are possible.

Figure 4:
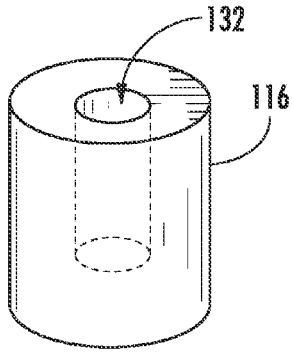
FIG. 4 provides a perspective view of a cup-shaped ice cube that can be made using the assembly of FIG. 3.

Conductors 96 may be made in rod-shaped form so as to create a substantially cup-shaped ice cube (see ice 98 being formed in FIG. 3 and resultant ice 116 in FIG. 4.) The term "ice cube" as used herein therefore does not refer strictly to a cube of ice; rather it refers to an individual piece of ice. The pieces of ice formed by the device disclosed herein, if a rod-shaped conductor is used, are somewhat cup shaped. That is, ice cube 116 is substantially cylindrical with a smaller diameter hole 132 part of the way through, corresponding to the shape of the conductor 96. To form such an ice cube, conductors 96 may extend into ice-making compartment 72 with a length 134 no more than three times its width 136. However, other conductor shapes could be employed, whether cylindrical with different ratios, or other shapes entirely.

Accordingly, the device disclosed above provides a reliable source of ice cubes in a shape often desired by consumers. The systems can be configured and controlled in various optional ways, and can also be connected to a chilled water system as well. The systems can be placed partially or wholly within a freezer, refrigerator and/or door of either, as desired.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice cube maker comprising:

an ice-making compartment having side walls;

at least one rod-shaped conductor extending distally into the compartment through one of the side walls;

a cooling device for cooling the conductor to a temperature sufficient to form ice on the conductor;

a misting system including a reservoir for water, a pumping device for creating a liquid mist from water in the reservoir and introducing the liquid mist into the ice-making compartment so that a portion of the liquid mist freezes on the conductor to form a cup-shaped ice cube thereon; and a return conduit connecting a drain of the ice-making compartment and the reservoir for transferring liquid mist not freezing on the conductor to the reservoir.

2. The ice cube maker of claim 1, wherein the portion of the rod-shaped conductor that extends into the ice-making compartment has a length no more than three times its width.

3. The ice cube maker of claim 2, wherein the rod-shaped conductor portion is substantially cylindrical.

4. The ice cube maker of claim 1, further including a heater for the ice-making compartment side walls for heating the side walls to a temperature sufficient to prevent the liquid mist from freezing on the side walls.

5. The ice cube maker of claim 1, further including a heater for heating the rod-shaped conductor to a temperature sufficient to harvest the cup-shaped ice cube from the rod-shaped conductor.

6. The ice cube maker of claim 1, wherein the misting system includes a controller, a water source and a low water sensor in the reservoir, the controller causing the misting system to fill the reservoir via the water source when the low water sensor signals a low water condition in the reservoir.

7. The ice cube maker of claim 6, wherein the controller initiates ice cube harvest by causing a heater to heat the rod-shaped conductor when the low water sensor senses the low water condition.

8. The ice cube maker of claim 6, wherein the misting system includes a high water sensor in the reservoir, the controller causing the water source to stop supplying water to the reservoir when the high water sensor signals a high water condition.

9. The ice cube maker of claim 8, wherein the low water sensor and the high water sensor are located on the reservoir such that an amount of water needed to take the water reservoir from a low water condition to a high water condition is substantially equal to the amount of water needed to create a desired amount of ice in an ice cube harvest.

10. The ice cube maker of claim 1, wherein the side walls include a bottom wall movable between an ice-forming position and an ice-dispensing position.

11. The ice cube maker of claim 10, further including an ice bucket, the ice bucket disposed for receiving ice cubes from the ice making compartment when the bottom wall is in the ice-dispensing position.

12. An ice cube maker comprising:

an ice-making compartment having side walls;

at least one rod-shaped conductor extending distally into the compartment through one of the side walls;

a cooling device for cooling the conductor to a temperature sufficient to form ice on the conductor;

a misting system including a reservoir for water, a pumping device for creating a liquid mist from water in the reservoir and introducing the liquid mist into the ice-making compartment so that a portion of the liquid mist freezes on the conductor to form a cup-shaped ice cube thereon; and a return conduit connecting a drain of the ice-making compartment and the reservoir for transferring liquid mist not freezing on the conductor to the reservoir;

the misting system including a water source for filling the reservoir in case a low water sensor signals a low water condition in the reservoir, the water source filling the reservoir until a high water condition is reached, the amount of water needed to create a desired amount of ice in an ice cube harvest being substantially equal to the difference between the high water condition and low water condition.

13. The ice cube maker of claim 12, wherein a heater heats the rod-shaped conductor when the low water condition occurs.

14. The ice cube maker of claim 12, further including a heater for the ice making compartment side walls for heating the side walls to a temperature sufficient to prevent the liquid mist from freezing on the side walls.

15. A refrigeration appliance comprising:

a refrigerated compartment;

an ice-making compartment within the refrigerated compartment and having side walls;

at least one rod-shaped conductor extending distally into the compartment through one of the side walls;

a cooling device for cooling the conductor to a temperature sufficient to form ice on the conductor;

a misting system including a reservoir for water, a pumping device for creating a liquid mist from water in the reservoir and introducing the liquid mist into the ice-making compartment so that a portion of the liquid mist freezes on the conductor to form a cup-shaped ice cube thereon; and a return conduit connecting a drain of the ice-making compartment and the reservoir for transferring liquid mist not freezing on the conductor to the reservoir.

16. The refrigeration appliance of claim 15, further including a heater for the ice-making compartment side walls for heating the side walls to a temperature sufficient to prevent the liquid mist from freezing on the side walls.

17. The refrigeration appliance of claim 15, further including a heater for heating the rod-shaped conductor to a temperature sufficient to harvest the cup-shaped ice cube from the rod-shaped conductor.

18. The refrigeration appliance of claim 15, wherein the misting system includes a controller, a water source and a low water sensor in the reservoir, the controller causing the misting system to fill the reservoir via the water source when the low water sensor signals a low water condition in the reservoir.

19. The refrigeration appliance of claim 18, wherein the controller initiates ice cube harvest by causing a heater to heat the rod-shaped conductor when the low water sensor senses the low water condition.

20. The refrigeration appliance claim 18, wherein the misting system includes a high water sensor in the reservoir, the controller causing the water source to stop supplying water to the reservoir when the high water sensor signals a high water condition.

* * * * *